United States Patent [19]

Schöllhorn et. al.

[11] 4,093,413

[45] June 6, 1978

[54] AUTOMATED APPARATUS FOR MOLDING OR DIE CASTING

[75] Inventors: Wolfgang Schöllhorn; Urban Ehret, both of Zuzwil, Switzerland

[73] Assignee: Gebruder Buhler AG, Switzerland

[21] Appl. No.: 802,313

[22] Filed: Jun. 1, 1977

[30] Foreign Application Priority Data

Jun. 9, 1976 Switzerland ..... 7238/76

[51] Int. Cl.[2] ..... B29C 6/00; B29C 7/00

[52] U.S. Cl. ..... 425/110; 425/121; 425/126 R; 425/129

[58] Field of Search ..... 425/110, 121, 126, 128, 425/129

[56] References Cited

U.S. PATENT DOCUMENTS

| | | | |
|---|---|---|---|
| 1,888,613 | 11/1932 | Apple | 425/129 R |
| 2,018,480 | 10/1935 | Apple | 425/128 |
| 2,030,132 | 2/1936 | Apple | 425/128 |
| 3,254,372 | 6/1966 | Hofbauer | 425/129 R X |
| 3,584,345 | 6/1971 | Beastrom | 425/129 R |
| 3,608,622 | 9/1971 | Bachelier | 425/129 R X |
| 3,663,136 | 5/1972 | Westermann | 425/128 X |
| 3,762,847 | 10/1973 | Deuter et al. | 425/129 R X |
| 3,849,041 | 11/1974 | Knapp | 425/128 X |

*Primary Examiner*—J. Howard Flint, Jr.
*Attorney, Agent, or Firm*—McGlew and Tuttle

[57] ABSTRACT

The apparatus manufactures, in repetitive cycles, apertured composite articles, such as stators for electric motors, including an apertured prefabricated insert. A machine applies molten molding material about the insert by die-casting or injection molding to constitute the composite. The apparatus includes a plurality of clamping mandrels for clamping in such apertures to constitute temporarily "mandrel-with-insert" or "mandrel-with-composite" combinations, a discharge station for discharge of the composites, a charging station for charging the mandrels with inserts, and a loading system with tongs, constituting holders for holding the mandrels, and with a conveying mechanism for repetitively carrying out a series of operations in appropriate timed sequences. These operations comprise extracting a mandrel-with-composite from the machine by a holder, loading a mandrel-with-insert into the machine from a holder, both these operations taking place at a loading/unloading position for the machine, setting off a composite from a holder at a discharge station, and taking up an insert, with the holder, at a charging station. The apparatus includes a pivoting manipulator including two conjointly pivoted bells, one to receieve an insert and the other to receive a composite. Each mandrel comprises a cylindrical main body having a plurality of grooves disposed symmetrically about its periphery, stepped wedges axially displaceable in each groove, stationary wedges cooperable with the stepped wedges for radial displacement, and a coupling at one end rotatable relative to the main body. The coupling is connected to the stepped wedges in a manner such that, upon rotation of the coupling, the stepped wedges are displaced axially in the respective grooves and the non-rotatable wedges are displaced radially thereby to expand the mandrel for clamping it in the aperture of an insert.

26 Claims, 9 Drawing Figures

K
894
84
86
85
841
IV
88
87
83
82
881
A
872
871
873
Fb
K
8
IV
893
821
81
892
B
895
891
89

38
37
381
371
k
r
k
R
t
383
382
89
a
373
372

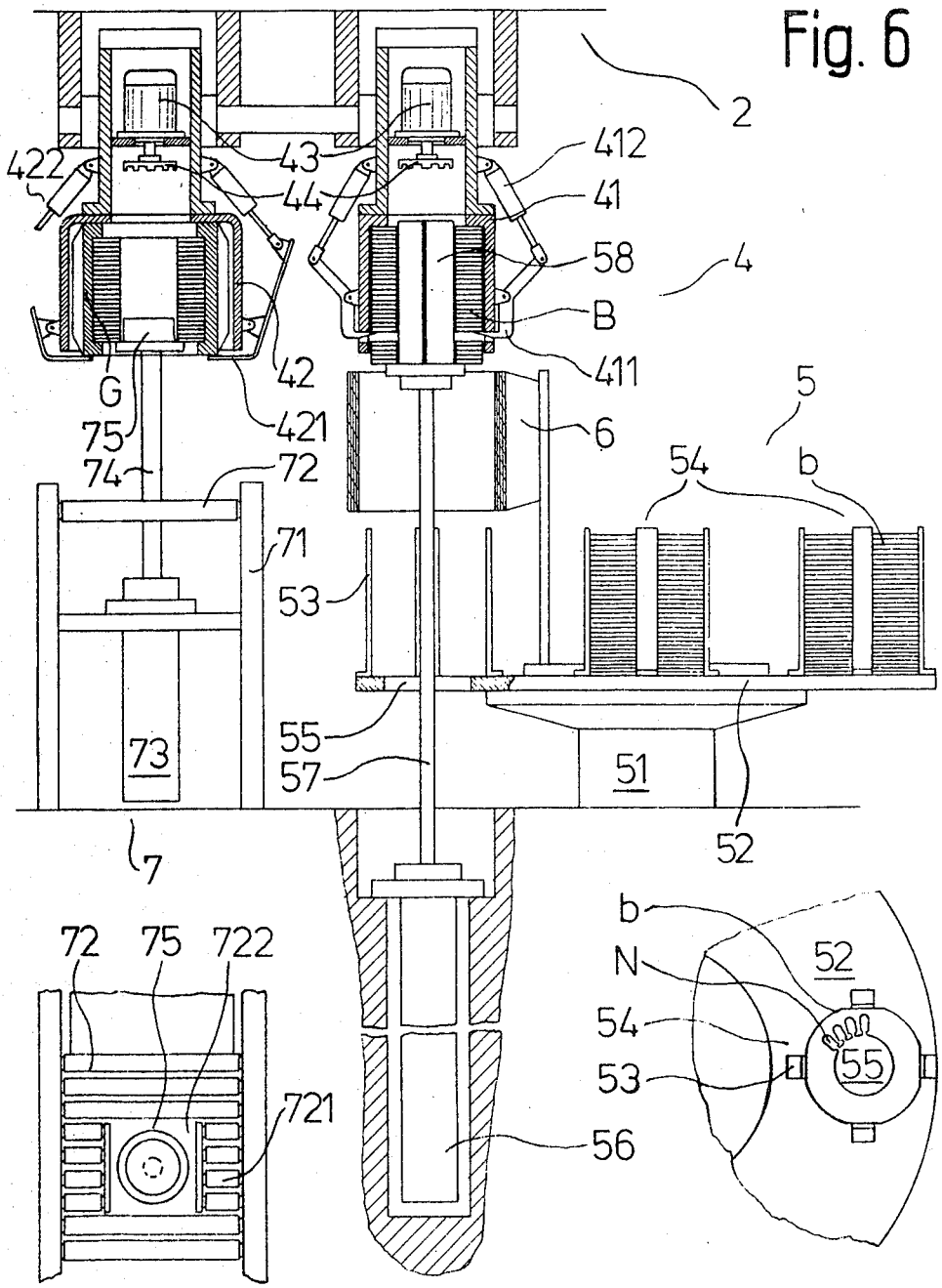
Fig. 6
Fig. 9
Fig. 7
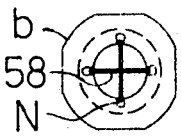
Fig. 8

AUTOMATED APPARATUS FOR MOLDING OR DIE CASTING

FIELD OF THE INVENTION

This invention relates to mold forming (namely molding or die casting) with insert and, more particularly, to an apparatus for the automated manufacture, in repetitive cycles, of apertured composite articles ("composites") having the aperture in a prefabricated insert thereof, which includes a machine for applying molten material (whether natural or synthetic) about the insert by a molding operation (such as die-casting or injection molding) to constitute the composite.

For technical and economic reasons, and also because of pysiological and sociological considerations, handling apparatus of various kinds have in recent years become more and more important as so-called peripheral systems in production fields using the various die casting and injection molding methods.

In the arrangement of complete production units and installations, such systems have been provided to an increasing extent for functions such as the sorting and holding of parts and the orderly loading, unloading and transferring of parts, with machines for die casting or injection molding of molten natural or synthetic materials.

BACKGROUND OF THE INVENTION

An arrangement for the production of stator housings, for electric motors, from aluminum die casting material is already known. To produce the laminated stator cores which are to have material cast around them, and to carry out the handling functions, several things are associated with the die casting machine, namely a pack forming station with a high-frequency furnace, a pivotable apparatus for the clamping of the laminations by means of inserted mandrel sleeves and a press for removing the mandrel sleeves from the finish cast stator housings with a water bath.

A gantry, with a carriage movable thereon and two gripping tongs capable of perpendicular movement on the carriage, namely a loading tongs and an unloading tongs, connects the clamping apparatus for the laminations with the die casting machine.

The punched laminations supplied by a first conveyor belt are tipped onto a mandrel sleeve at the pack forming station, weighed and the lamination assembly pressed together, if required, and brought by the conveyor belt first into the high-frequency furnace for preliminary heating and then to the pivotable clamping apparatus. The latter engages in the mandrel sleeve of the lamination assembly which is entered therein with the bore disposed vertically and pivots the assembly into a horizontal position relatively to the loading tongs of the gantry which tongs is in the position of readiness. The loading tongs, by means of a head piece the extension of which is displaceable into the bore of the mandrel sleeve, takes over the lamination assembly. When the carriage, with the two gripping tongs and the lamination assembly, moves over the mold of the die casting machine, it again remains in the position of readiness.

The casting operation and the subsequent cooling time for the castings take place during the steps described above. After the cooling time has elapsed, the lamination assembly, together with the stator housing which has been cast around it, is removed from the mold by means of the unloading tongs and then the new lamination assembly is placed in the mold by the loading tongs.

Subsequently the carriage returns to the pivotable clamping apparatus, to which the stator housing is delivered by the unloading tongs. After the subsequent cutting-off of the sprues and the casting residue from the stator housing and the transfer of the head piece from the unloading tongs to the loading tongs, the mandrel sleeve is pressed out of the bore in the stator housing in the press provided for this purpose.

While the finished stator housing and the casting residue with the sprues are taken away by a second and third conveyor belt, respectively, to a depositing area and to the melting furnace, respectively, the mandrel sleeve, removed from the bore in the finished stator housing, falls into a water bath. A fourth conveyor belt then returns the recooled mandrel sleeve to the pack forming station.

In order to provide for continuous operation of the die casting machine, this system, in addition to the two headpieces, of which one is situated in the casting mold and the other above the mold, in the region of the pivotable clamping apparatus or in an intermediate location between these two, requires six mandrel sleeves for each stator size to be cast. Apparatus such as a mandrel press, a cooling station with a water bath and a conveyor belt are also necessary for returning the sleeves into the preparation process.

The preparation process is carried out in locally separated part-steps along the supply conveyor belt. The individual incremental movements are time consuming, so that the cycle time of the die casting machine, which is becoming shorter and shorter with the use of relatively small electric motors, is not sufficient for all the manipulating functions.

OTHER PRIOR ART

For a further understanding of the background of the present invention, reference is made to German Offenlegungsschrift No. 2,032,542, showing an expandible winding mandrel, to U.S. Pat. No. 3,666,194, disclosing coiling and uncoiling metallic strip material, and to French Patent of Addition No. 2,096,888, disclosing a machine for pressure molding, particularly for forming the rotors of electric motors.

SUMMARY OF THE INVENTION

In accordance with the invention, the apparatus for the automated manufacture, in repetitive cycles, of apertured composite articles ("composites") having the aperture in a prefabricated insert thereof, includes a machine for applying molten natural or synthetic material about the insert by die-casting or injection molding to constitute the composite, a plurality of clamping mandrels for clamping in such apertures to constitute temporarily "mandrel-with-insert" or "mandrel-with-composite" combinations, a discharge station for discharge of the composites, a charging station for charging the mandrels with inserts, and a loading system having holding means for holding the mandrels and conveying means for repetitively carrying out the following operations in appropriate timed sequence, (a) at a loading/unloading position for the machine ("load position"), with a holder, taking hold of a mandrel-with-composite from the machine, (b) at the load position, loading a mandrel-with-insert into the machine from a holder, (c) at a set off position for the discharge station, setting off at least a composite from a holder, and (d) at a take-up position for the charging station, taking up at least an insert with a holder.

According to another aspect, the invention provides apparatus for handling a hollow insert part to which further parts can be added by pressure die casting or injection molding of molten natural and synthetic materials, in a production unit with a loading system arranged between a casting machine and an intermediate store or a preparation station, for prefabricated insert parts, and with a pivoting manipulator which is provided for transfer of the hollow insert part to the loading system and for taking over the finish cast workpiece from the latter, in the region of the intermediate store or preparation station, and a linked delivery station in which, for clamping and holding the hollow insert part or the finish cast workpiece of specific size during preparation and delivery respectively, on the path of conveyance and during the loading, casting and unloading operations, there are provided two clamping mandrels which are interchangeable, at the rhythm of the casting cycles by the loading system between the pivoting manipulator and the casting machine.

By providing such clamping mandrels, the number of elements which are required for clamping and holding the hollow insert parts, can be reduced to two per size. The clamping mandrels can be arranged to be interchangeable on a straight path of conveyance between the pivoting manipulator and the casting machine. It thus becomes possible to do without special apparatus for returning mandrels to the preparation station, so that, e.g. a mandrel press, a cooling station with a water bath and an associated conveyor belt can be dispensed with.

The apparatus of the invention, thus provided with clamping mandrels, also provides the possibility of substantial simplification in the further construction which will be described in more detail below, since the arrangements for the preparation and preheating of the insert parts can be combined, e.g. in the same location as the pivoting manipulator. By use of such construction, it is possible to avoid having buffer zones. With a smaller number of incremental movements necessary it is possible to achieve a shorter time cycle, which thus can match, or match more closely, the fastest speed of the casting machine which, after all, is the most expensive component of the production unit, for the different workpiece sizes which are to be produced.

Conveniently, each of the clamping mandrels comprises a cylindrical main body with an axial bore and a plurality of longitudinal grooves distributed symmetrically around its periphery, for receiving axially displaceable stepped wedges which cooperate with similarly constructed associated wedges with radially mobile clamping jaws, the associated wedges also being arranged in the grooves.

At the end of the main body, there is provided a freely rotatable coupling disc with end teeth and an extension constructed with an external screwthread, the external screwthread engaging with the internal screwthread of a displacement sleeve which is connected to the axially displaceable stepped wedges and which itself rotates as a unit with the main body but is axially movable thereon.

In order to prevent the casting material from entering between the clamping jaws, it is advisable to support the clamping jaws relatively to one another by way of sealing sliding surfaces.

The provision of at least one centering rib at the external surface of each clamping jaw, which centering rib extends parallel to the axial bore of the main body and can cooperate with a suitable recess provided in the hollow insert part, makes it possible to obtain a centered clamping of the insert part, which is also held securely against rotational movement.

To adapt the clamping mandrels to the internal width of a plurality of hollow insert parts of different sizes, it may be advantageous to make it possible to modify the clamping mandrels so that they too can be of different sizes when in the clamped state. This can be achieved by arranging sets of clamping jaws in the grooves of the main body, the dimensions of the clamping jaws varying correspondingly in the radial and peripheral directions from set to set. In this way, it is possible to use the main body with the displacement mechanism inseparable therefrom for a number of insert parts of increasing size.

The clamping mandrel and a conically shaped head part, adapted to be inserted in the axial bore of the main body of the mandrel, which are to be conveyed jointly at the rhythm of the casting cycles between the pivoting manipulator and the casting mold, are advantageously united to form a single unit. For this purpose, an annular shoulder surface can be formed in the central region of the axial bore of the main body and, in a smaller diameter bore portion remote from the coupling disc, the central supporting pin of the head part at the end of the clamping mandrel remote from the coupling disc can be guided for axial displacement but secured against rotation. The axial displacement of the head part in the direction away from the coupling disc can be limited by a collar which is provided at the free end of the supporting pin and which abuts against the shoulder surface.

In order to allow the head part, which at the same time is a mold part and assists in shaping the cast or molded article, to bear against the insert part, there may conveniently be provided an annular external supporting element secured detachably thereon in the vicinity of the periphery and, between this element and the external surface of the clamping mandrel, a substantially annular external compensating element is also arranged releasably on the mandrel.

To accommodate insert parts of different sizes, there can be providing supporting and compensating elements of different dimensions in accordance with the sizes of the insert parts, the internal dimensions of the compensating elements also being of different magnitudes according to the requirements of the insert parts.

The pivoting manipulator can consist of a loading bell and an unloading bell, these being mounted to be pivotable on a stand and capable of pivoting jointly with one another between the vertical position and the horizontal position. The loading bell has an internal configuration corresponding to the outline of the insert part, and the unloading bell an internal configuration adapted to the outline of the finish cast workpiece.

To hold the insert part received in the loading bell and/or to choose an appropriate length, it is desirable to arrange, in the region of the opening of the loading bell, at least one trimming wedge which, by means of a drive also arranged on the loading bell, can be driven toward the bell axis and withdrawn therefrom parallel to the plane of the bell opening. Similarly there may conveniently be provided, at the periphery of the opening of the unloading bell, holding latches to prevent the finish cast workpiece from slipping out when the unloading bell is pivoted into the vertical position. The holding latches too can, by means of a drive arranged on the unloading bell, be moved parallel to the opening plane in the direction towards the bell axis and in the direction oppositely thereto.

There is also provided, in the heads of the loading and unloading bells, respective drives for clamping or unclamping the clamping mandrel inserted in the hollow insert part situated in the bell.

In a particularly advantageous construction of the preparation station, it comprises a floor mounted on a fixed frame and capable of moving in a horizontal plane, with a plurality of storage places, arranged on the floor at regular intervals, for orientated stocking of interim-stored insert parts or components of such parts, and a lifting arrangement. The latter is so arranged below the floor in the region of the frame that it is situated at the same time below the loading bell of the pivoting manipulator, and in the vertically pivoted-round position the prolongation of the bell axis passes through the geometric center of the lifting arrangement.

The storage places, each provided with a floor opening, can then be moved rhythmically between the lifting arrangement and the loading bell into a position coaxial therewith.

Arranging the preparation station in the manner described affords the advantage that, between the preparation station and the loading bell of the pivoting manipulator, a preheating station with a through bore for the insert parts can be provided, the through bore being situated coaxially with the loading bell situated in the vertical position.

Conveniently the delivery station is in the form of a roller track mounted on a fixed frame, with a lifting arrangement situated below it. In the region of movement of the lifting arrangement the roller track is constructed as two rows of rollers, which are separated from one another by an intervening space for the movement of the lifting arrangement through the plane of the roller track.

As the lifting arrangement for the separation station and the lifting arrangement for the delivery station, it is suitable to provide, in each case, a hydraulic piston and cylinder unit, and conveniently the piston rod of the former, in the upper region thereof, is shaped to correspond to the internal configuration of the hollow insert part, and the piston rod of the latter comprises a centering disc at its free end.

If a running rail gantry is used with a loading system capable of moving in the longitudinal direction thereof, the loading system having a trolley for movement transversely to the longitudinal direction of the gantry, with two vertically liftable and lowerable gripping tongs arranged on the trolley parallel to one another, and also three pressure cylinders provided for operating the trolley and the gripping tongs, the tongs arms of the gripping tongs can be provided with interchangeable tongs jaws whose internal surface is shaped to correspond to the conicity of the head part of the clamping mandrel. It is convenient to provide, on those end faces of the tongs arms which are remote from the insert part being handled, in each case a releasably secured strap as an abutment for the gripped head part of the mandrel, and the straps of one gripping tongs, namely the loading tongs, are made wedge-shaped at their ends directed towards the head part which is gripped.

The invention also concerns the use of the apparatus described hereinbefore, more particularly for the production of the stator housing of electrical machines by pressure die casting of molten metal about the stator laminations body. However, the apparatus proposed, without departing from the principles of the present invention, may also be used in production units for injection molded articles made of rubber or plastics material, produced by molding around hollow insert parts consisting of various materials.

An object of the invention is to provide an improved apparatus which can overcome at least some of the disadvantages mentioned above, in known apparatus for automated manufacture of apertured composite articles.

Another object of the invention is to provide such an improved apparatus in which the number of elements required for clamping and holding the hollow insert parts can be reduced to two per size.

A further object of the invention is to provide such an improved apparatus in which it is possible to do without special apparatus for returning mandrels to a preparation station.

Yet another object of the invention is to provide such an improved apparatus providing the possibility of substantial simplification in construction of its components.

A further object of the invention is to provide such an improved apparatus in which it is possible to reduce the number of incremental movements and thereby to achieve a shorter time cycle which can match, or match more closely, the fastest speed of a casting machine.

For an understanding of the principles of the invention, reference is made to the following description of a typical embodiment thereof as illustrated in the accompanying drawings.

BRIEF DESCRIPTION OF THE DRAWINGS

In the Drawings:

FIG. 6 is an elevational view, partly in section, showing on a larger scale, the right-hand half of the production unit according to FIG. 1, comprising a pack-forming station, a delivery station, a pivoting manipulator and a preheating station;

FIG. 7 is a fragmentary plan view of part of the pack-forming station according to FIG. 6, showing only one storage place, the remainder of the station being shown broken away;

FIG. 8 is a plan view of the cross-shaped piston rod of an operating cylinder which brings the stator laminations body from the pack-forming station to the pivoting manipulator; and FIG. 9 is a plan view of the delivery station according to claim 6.

DESCRIPTION OF THE PREFERRED EMBODIMENT

Figure 1:
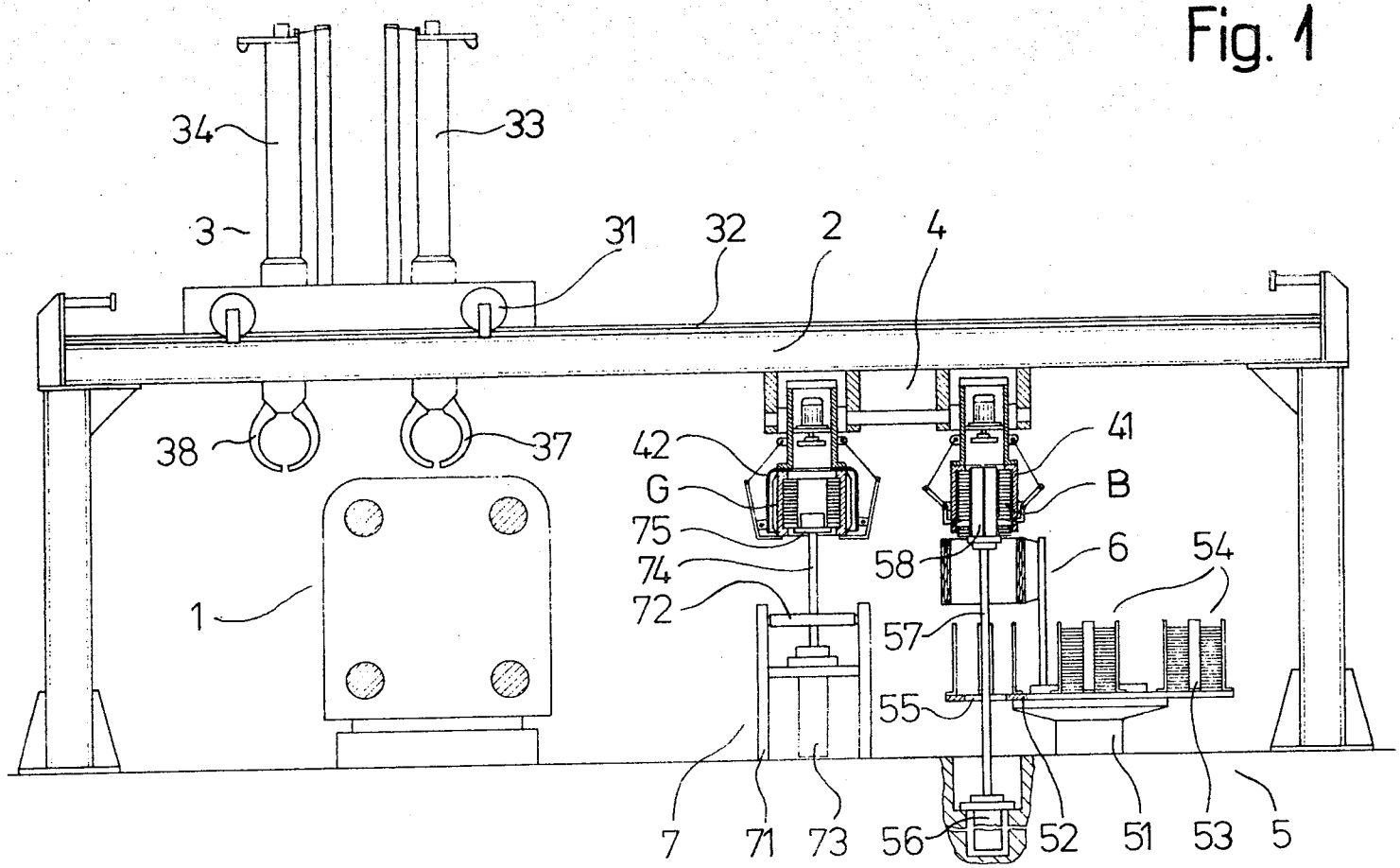
FIG. 1 shows a production unit for the die casting of the strator housing of electrical machines, as seen in section along the section plane I—I in FIG. 2.
Figure 2:
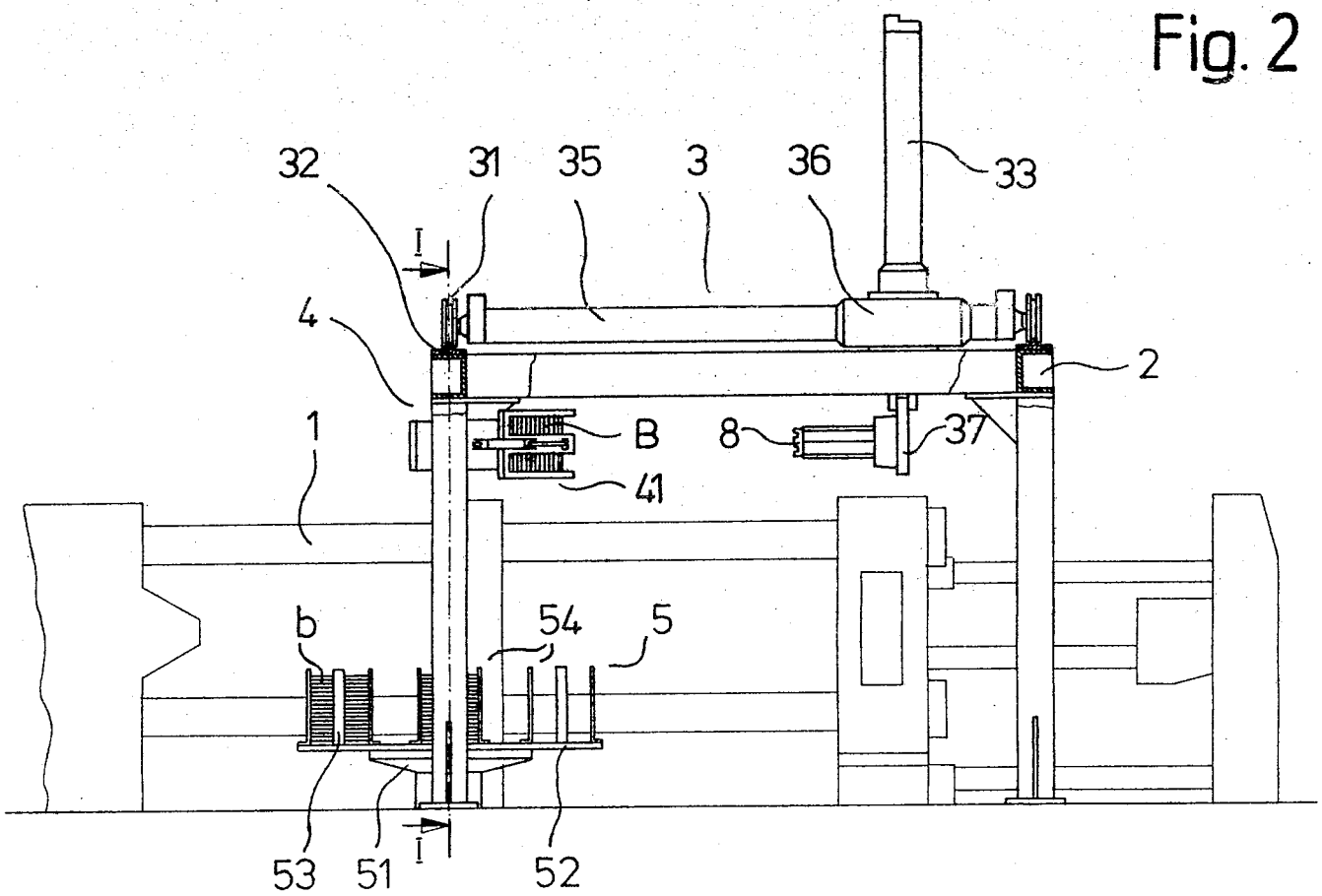
FIG. 2 is a front view of the production unit shown in FIG. 1.

The apparatus according to the invention, shown diagrammatically by way of example in FIGS. 1 and 2, comprises a horizontal die casting machine 1, a loading system 3 adapted to move on a running rail gantry 2, a pivoting manipulator 4 provided on the gantry 2, a charging station in the form of a pack-forming station 5, a preheating station 6 and a discharge station in the form of a delivery station 7.

FIG. 2 also shows a clamping mandrel 8, which is intended for the handling of stator lamination bodies B ("the insert") about which casting is to be carried out, and finish cast stator housings G ("the composite") insert B has an aperture in the form of a bore which of course also constitutes the aperture of the composite. Running rail gantry 2 spans the entire production unit and carries loading system 3.

This loading system 3 connects die casting machine 1 with pivoting manipulator 4 which cooperates with the stations 5 and 6, for the preparation and preheating of stator laminations bodies B about which casting is to be carried out and with delivery station 7 for the finish cast stator housings G.

Loading system 3 is constructed similarly to a gantry crane and can, because of its three-dimensional mobility, pass over the entire space of the production unit. The longitudinal movement of loading system 3 is effected by means of its wheels 31 which run on guide rails 32. The transverse and lifting movements are effected by pressure cylinders 33, 34 and 35. On conveying means in the form of a trolley 36 there are arranged the two vertical pressure cylinders 33 and 34, for the vertical lifting movement of respective holding means in the form of gripping tongs 37, 38. One pressure cylinder 33 is connected to the loading tongs 37 and the other pressure cylinders 34 to the unloading tongs 38.

The transverse displacement of the trolley 36 is effected by means of the horizontally oriented pressure cylinder 35.

In contrast to a normal gantry crane, however, the movement sequence of loading system 3 is programmed in this production unit, so that the two gripping tongs 37, 38 can be brought into their several positions quickly and precisely in accordance with the requirements of the production sequence.

Pivoting manipulator 4 is arranged on running rail gantry 2. It comprises a charging or loading bell 41 and a discharge or unloading bell 42, which are mounted to be jointly pivotable between the vertical and the horizontal positions by a drive (not shown for simplicity of illustration).

In FIG. 1 both the loading bell 41 and also the unloading bell 42 are shown in their vertical position.

In this position, loading bell 41 is loaded with a stator laminations body B and a finish cast stator housing G is removed from unloading bell 42. The internal confuguration of the loading and unloading bells 41 and 42*m* respectively, is constructed in accordance with the outline of the stator laminations body B and the stator housing G respectively.

Pack forming station 5 comprises a fixed frame 51 and a circular floor 52 rotatably mounted on the frame to act as a loading table, with a plurality of storage places 54 formed at regular intervals at the periphery thereof by vertically arranged strips 53 of flat bar.

The stator laminations *b* are stacked, in register with one another confined by strips 53 of storage places 54. Floor 52 has an aperture 55 at each storage place 54, in alignment with the bore of the stator laminations *b*. In the foundation below floor 52, there is a lifting cylinder 56 which is directed coaxially with loading bell 41 when the latter is in a vertical position over pack forming station 5, as in FIG. 1.

The piston rod 57 of lifting cylinder 56 can be run upwards into the interior of loading bell 41 through floor aperture 55 of a storage place 54 which is guided in timed sequence into position between loading bell 41 and lifting cylinder 56 coaxial with these. In its upper portion 58, piston rod 57 is cross-shaped so that, engaging in four opposite grooves N of the stator laminations *b* (not visible in FIGS. 1 and 2 but more particularly referred to below), it can lift these in their orientated state from storage place 54 into loading bell 41.

In this lifting movement, piston rod 57 with the stator laminations *b* passes, with an intermediate halt, through preheating station 6, which is in the form of a high-frequency coil (see FIG. 1) the bore of which is also arranged coaxially with that of loading bell 41.

Delivery station 7 is used for taking the finish cast stator housing G from unloading bell 41. It comprises a roller track 72 mounted on a stationary frame 71, and a lifting cylinder 73 which is arranged below and which is situated coaxially relatively to unloading bell 42 of pivoting manipulator 4 when bell 42 is in the vertically pivoted position shown in FIG. 1. The piston rod 74 of lifting cylinder 73 can be extended to the aperture of unloading bell 42 and, in each case, a finished stator housing G situated therein can be taken by means of a centering disc 75 formed at the end of piston rod 74, and lowered on to roller track 72.

In FIG. 2 the delivery station is not illustrated.

As FIG. 2 shows, the taking up of a stator laminations body B, about which casting is to be carried out, from loading bell 41 (and also the setting off of a finish cast stator housing G into unloading bell 42) are each effected by means of a clamping mandrel 8 in the horizontal position of pivoting manipulator 4. FIG. 2 shows the position of loading tongs 37 from which the tongs, with a clamping mandrel 8, is introduced into loading bell 41 to take therefrom a stator laminations body B about which casting is to be carried out.

In FIG. 2, unloading bell 42 is masked from view by loading bell 41 and unloading tongs 38 of loading system 3 is masked by loading tongs 37 extending about clamping mandrel 8.

Figure 3:
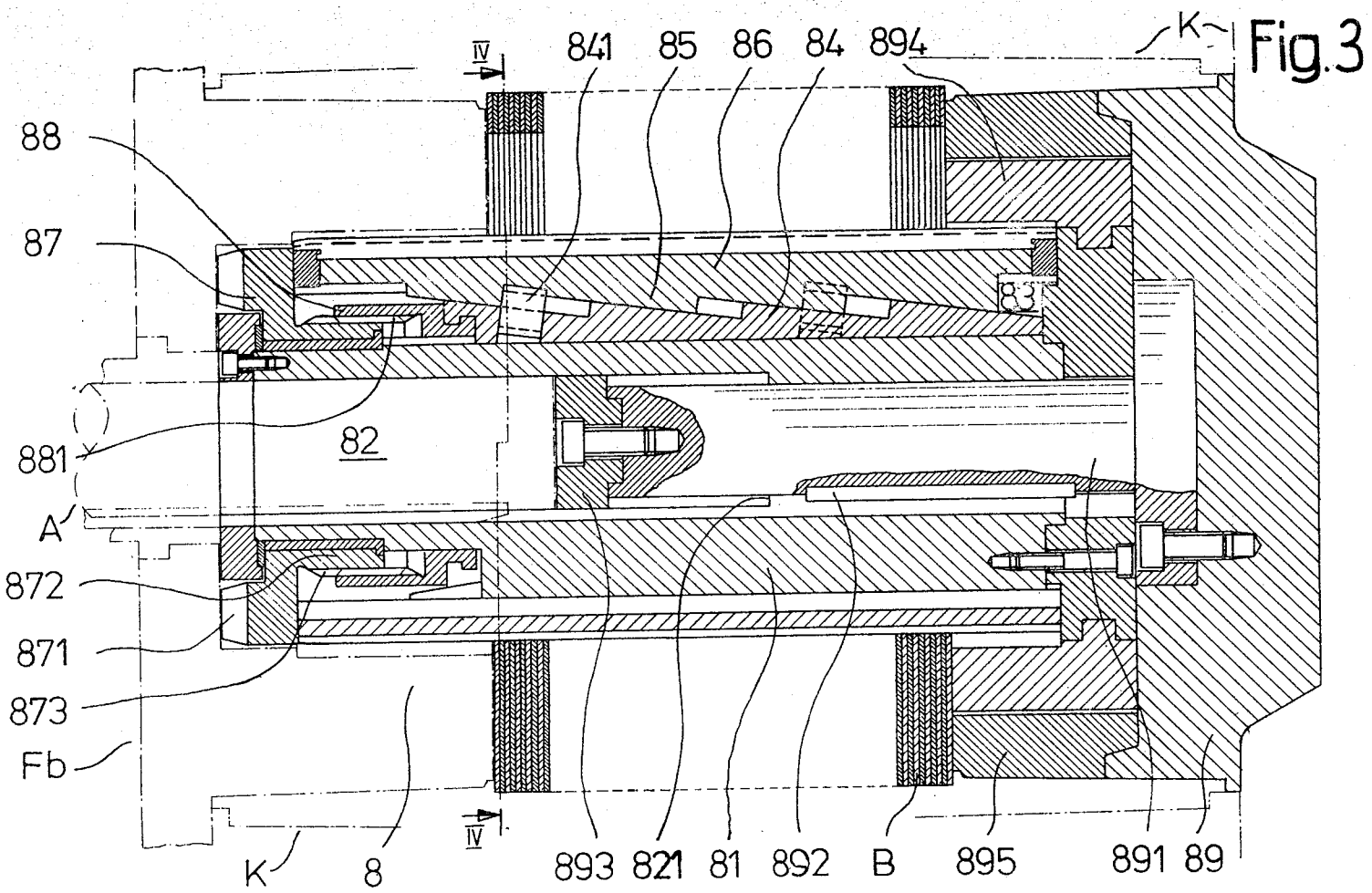
FIG. 3 shows, in longitudinal section, a clamping mandrel for handling hollow insert parts, as seen along the section plane III—III in FIG. 4, the clamping mandrel being disposed in a state of readiness together with a mounted stator laminations body about which casting is to be carried out in the closed mold of the die casting machine of the production unit.
Figure 4:
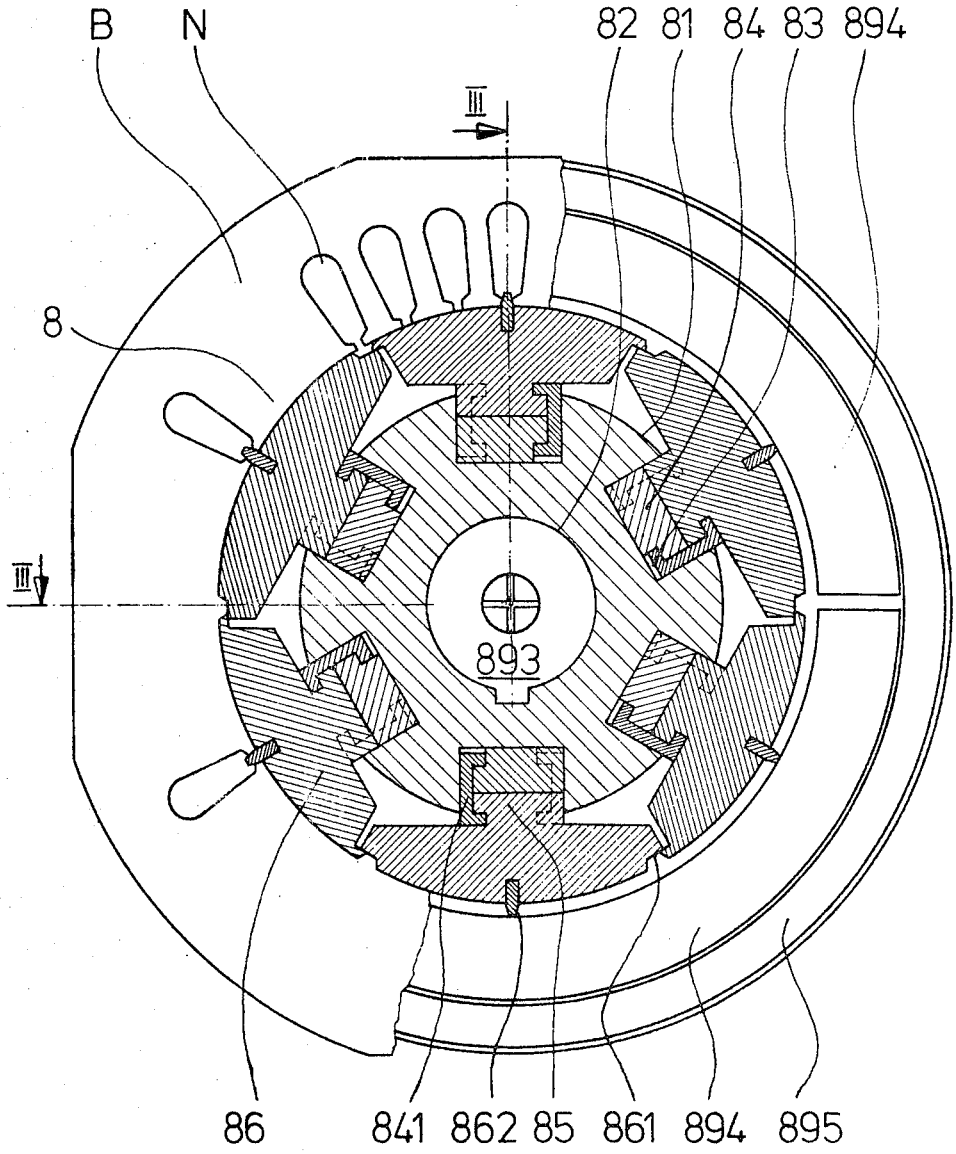
FIG. 4 is a transverse sectional view of the clamping mandrel and the stator laminations body, partly in fragmentary manner, along the section plane IV—IV of FIG. 3.

FIG. 3 shows a longitudinal sectional view through clamping mandrel 8 and FIG. 4 a cross-section thereof. The two figures will be described together.

Clamping mandrel 8 is inserted, together with a stator laminations body B about which casting is to be carried out, into the mold indicated with chain-dotted lines in FIG. 3. $F_b$ indicates the movable mold half, A the central ejector thereof, and K the core members which can travel inwards and outwards and which form the external configuration of the periphery of stator housing G.

Clamping mandrel 8 comprises a cylindrical main body 81 with an axial bore 82 and a plurality of longitudinal grooves 83 which are distributed symmetrically the periphery of the main body. Each groove receives a respective axially displaceable stepped wedge 84 and a similarly constructed associated wedge 85 cooperating with the stepped wedge.

Each of the associated wedges 85, which are stationary in the axial direction, carries a respective clamping jaw 86 and the wedges 85 are movable in a radial direction together with the associated damping jaws.

Coupling means, in the form of a coupling disc 87 with end teeth 871, is rotatably mounted on that end of main body 81 which is directed towards movable mold half $F_b$. The extension 872 of coupling disc 87 is provided with an external screw thread 873.

A displacement sleeve 88, which is connected with the displaceable stepped wedges 84 and which is fast against rotation with respect to main body 81 but axially movable relative thereto, is in driving connection with coupling disc 87 by way of an internal screw thread 881 formed on the sleeve and the external screw thread 873 of extension 872.

When coupling disc 87 is rotated by way of end teeth 871 with which a drive (to be explained below) is in engagement, displacement sleeve 88 is moved away from extension 872 (towards the right in FIG. 3) from its initial position corresponding to the non-clamped state of clamping mandrel 8, in which it abuts extension 872 of coupling disc 87. Stepped wedged 84, which are moved at the same time, press the similarly shaped associated wedges 85, with clamping jaws 86 secured thereon, away from main body 81 in the radial direction. In the clamped condition, the totality of the external surfaces of clamping jaws 86 constitutes the maximum cylindrical outer surface of clamping mandrel 8.

When coupling disc 87 is rotated in the opposite direction, displacement sleeve 88 is retracted towards extension 872 along with stepped wedges 84 which, in turn and by means of straps 841, draw associated wedges 85 along with clamping jaws 86 towards main body 81 in a radiak direction. In FIG. 4, six clamping jaws 86 are shown, which are in the form of a segment of a circle and which bear against one another by way of sealing sliding surfaces 861, to prevent the entry of molten metal into the wedge mechanism 84, 85. But it would also be possible, in some types of applications, to provide a different number of clamping jaws, and these could be constructed without sealing sliding surfaces, with straight side walls.

FIG. 4 also clearly shows a centering rib 862 extending parallel to axial bore 82 of main body 81 and secured to the external surface of each clamping jaw 86. In the clamped condition of clamping jaw 88, in which clamping jaws 86 are moved into their outermost position of clamping mandrel 8 as shown in FIG. 4, the centering ribs 862 engage in a plurality of grooves N distributed symmetrically along the periphery of the bore of the stator laminations body B. In this way, it is possible to clamp the stator laminations body B on clamping mandrel 8 in a centered fashion, prevented from rotational movement.

To clamp a stator laminations assembly B having a larger or smaller stator bore than in FIGS. 3 and 4, clamping jaws 86 with correspondingly larger or smaller dimensions in the radial and peripheral directions can be inserted in grooves 83 of the same main body 81. In this way, the outer dimension of clamping mandrel 8, in the clamped condition, can be adapted in appropriate steps to several standard stator sizes, keeping the same main body 81.

As FIG. 3 shows, an annular shoulder surface 821 is formed in the central region of axial bore 82 of main body 81.

At the end of clamping mandrel 8 remote from coupling disc 87, there is a conically shaped head part 89 whose central supporting pin 891 is guided, for axial displacement, in a portion of axial bore 82 having a smaller diameter, and prevented from rotational movement by means of an inserted key 892.

The conically shaped periphery of head part 89 is a mold part which helps to form the stator housing G.

The axial displacement of supporting pin 891, and therefore of head part 89, in the direction away from coupling disc 87 is limited by a collar 893 which is provided at the end of supporting pin 891 remote from central ejector A, which collar abuts against the shoulder surface 821.

Two rings 894, 895 are provided between head part 89 and the stator laminations body B clamped on clamping mandrel 8. The inner two-part ring 894 (see FIG. 4) is secured releasably on the clamping mandrel and us used as an intermediate member, in the axial direction, between the stator laminations body B and the facing abutment surface of head part 89 and, in the radial direction, between the outer surface of clamping mandrel 8 and outer ring 895.

The latter is releasably secured on the abutment surface of head part 89 in the vicinity of the periphery, and constitutes a mold part which also helps to form the stator housing G.

In adaptation to the standard size of the stator housings G, the two rings 894, 895 can be selected with a length adapted to that of the particular stator laminations body B, and, at the same time, the internal diameter of inner ring 894 can be varied in appropriate steps in accordance with that of the stator laminations body B.

Figure 5:
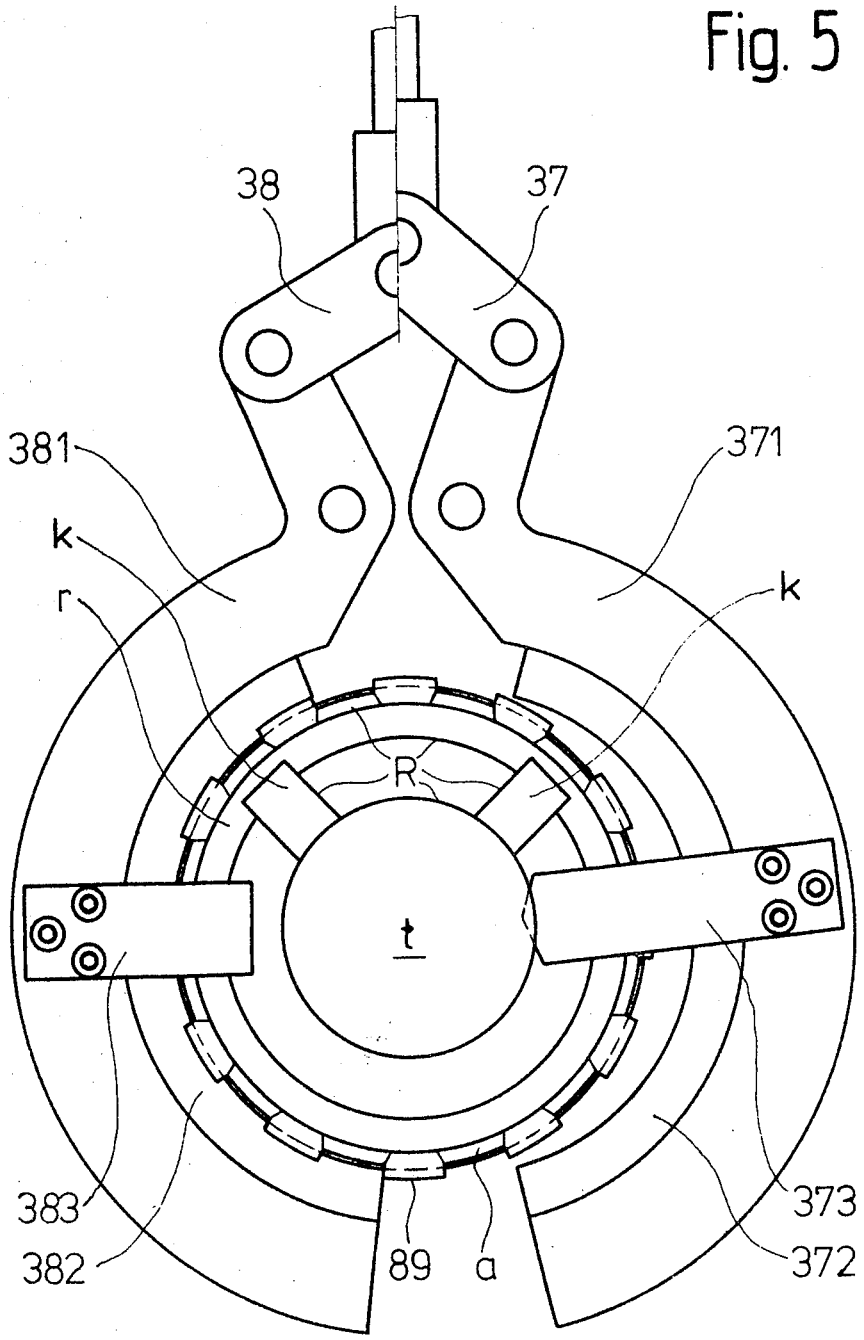
FIG. 5 is an elevation view of the loading system tongs and shows, in the left-hand half of the illustration the transport of a finish cast stator housing held on the clamping mandrel after the housing has been removed from the mold by means of the unloading tongs of the loading system and shows, in the right-hand half of the illustration, the severing of the casting residue from the stator housing by means of the loading tongs of the same loading system.

FIG. 5 shows two halves of loading and unloading tongs 37 and 38, respectively. The two gripping tongs 37, 38 are constructed identically apart from a detail which will be described below.

Each tongs consists of two tongs arms 371 and 381, respectively, in which there is inserted a respective interchangeable tongs jaw 372 and 382. The latter are adapted to the dimensions of head part 89 of clamping mandrel 8 which is to be gripped.

In FIG. 5 there is shown, between the two tongs jaws 372 and 382, head part 89 with the casting residue R which is composed of the casting tray *t*, sprue ring *r*, the runners *k* and the gates *a*. The gates *a* shown at the periphery together form the casting cross-section of the stator housing G which is to be cast about the stator laminations body B. They are detached when the latter is removed from the mold.

In the left-hand half of FIG. 5, there is shown how head part 89 of clamping mandrel 8 is gripped by unloading tongs 38 during the conveying of a finish cast stator housing G from die casting machine 1 to delivery station 7. A strap 383, arranged on each of the tongs arms 381, is used as an abutment for head part 89. The right-hand half of unloading tongs 38 is not shown in FIG. 5.

The right-hand half of FIG. 5 shows the severing of the attached casting residue R from head part 89 by loading tongs 371 is provided at each of the tongs arms 371 (only the right-hand tongs half is visible in FIG. 5), and whose end directed towards the casting tray *t* is wedge-shaped.

As the right hand tongs half in FIG. 5 indicates, the two wedge-shaped straps 373, at the closing movement of the two arms 371 of loading tongs 37, partly penetrate into the casting tray *t* which, in fact, consists of relatively soft aluminium. Loading tongs 37, however, can only close to an incomplete extent.

The finished stator housing G, which was previously inserted in unloading bell 42 by unloading tongs 38 and which, in FIG. 5, together with the clamping mandrel 8 still clamped in the stator bore, is covered by the halves of the two gripping tongs 37, 38, is held fast by means of an arrangement which will be described below belonging to unloading bell 42.

It will easily be appreciated, with the help of FIG. 2, that the entire casting residue R can be detached from head part 89 of clamping mandrel 8 by a small travel of horizontal pressure cylinder 35, trolley 36 with loading and unloading tongs 37 and 38 being moved away from pivoting manipulator 4. This detaching movement takes place at right angles to the plane of the drawing in FIG. 5 in the upward sense.

FIGS. 6, 7, 8 and 9 show, on a larger scale, the right-hand half of the production unit according to FIG. 1 with pivoting manipulator 4, pack forming station 5, preheating station 6 and delivery station 7. The same reference numerals as in FIG. 1 and FIG. 2 have been used to designate like or equivalent apparatus parts.

FIG. 6 shows the details of pivoting manipulator 4. In the region of the aperture of loading bell 41, there are provided two trimming wedges 411 which are situated opposite one another. Operated in each case by a suitable associated drive 412, the trimming wedges 411 can be advanced and withdrawn parallel to the plane of the aperture in the direction towards the axis of the bell.

By advancing trimming wedges 411 in the direction of the bell axis, it is possible to separate-off the stator laminations *b*, surplus to requirements, at the lower end of a lamination assembly, which has previously been introduced by lifting cylinder 56 of pack forming station 5 into loading bell 41 situated in the vertical position, and is fixed on cross-shaped portion 58 of piston rod 57 of the bell with the suitably oriented grooves N. In this way it is possible to produce bodies B consisting of stator laminations of a desired length.

In a similar manner, retaining latches 421 are arranged at the periphery of the aperture of unloading bell 42, and which can also be moved, by means of an associated drive 422, parallel to the plane of the aperture again, in the direction towards and away from the axis of the bell.

In the run-in state, retaining latches 421 hold a finish cast stator housing G which was inserted in unloading bell 42 by unloading tongs 38, and they retain it first during removal of the casting residue R by loading tongs 37 while still in the horizontal position of unloading bell 42 (compare FIGS. 2 and 5) and continue to retain it during the pivoting and after the pivoting of the unloading bell into the vertical position, until the stator housing G is taken by centering disc 75 on piston rod 74 of lifting cylinder 73 of delivery station 7.

The two bells 41 and 42 respectively can be provided with a plurality of pairs of trimming wedges 411 and retaining latches 421 distributed symmetrically around the external periphery of the bells, and associated drives 412 and 422, respectively.

A drive 43 with a toothed wheel 44 is also provided at the head of each of the two bells 41, 42. The toothed wheels comprise end teeth corresponding to end teeth 871 of coupling disc 87 of clamping mandrels 8.

The clamping of a clamping mandrel 8 pushed by loading tongs 37 into a stator laminations body B when loading bell 41 is pivoted horizontally, and the unclamping of the mandrel when previously taken from a stator housing G situated in unloading bell 42 disposed at the same time in a horizontal position, likewise by loading tongs 37, is carried out by means of drives 43. As long as a clamping mandrel 8 together with a stator laminations body B or stator housing G is situated in the loading or unloading bell 41, 42, respectively, end teeth 871 of coupling disc 87 always engage with those of toothed wheel 44 of the relevant drive 43.

In FIG. 7 there is shown a fragmentary view of the rotatable circular floor 52 of pack forming station 5 which is used as a loading table, with a storage place 54, as seen from above. Storage place 54 is formed by four strips 53 arranged perpendicularly relatively to floor 52 and between which stator laminations *b* are stacked. The sections at the periphery of the stator laminations *b*, where punched to form straight sides, abut strips 53 so that the laminations *b* lie one above the other in identical register and their slot recesses N and central bores are in alignment with one another.

The floor aperture 55 is in alignment with the stator bore and is visible through it. Piston rod 57 of lifting cylinder 56 passes through the floor aperture and, by means of its cross-shaped upper portion 58, can lift a laminations assembly into loading bell 41 from the loading position shown in FIG. 6.

FIG. 8 shows the pack of stator laminations *b* centered on cross-shaped portions 58 of piston rod 57 during lifting movement into loading bell 41, as seen from above, the edges of cross-shaped piston rod portion 58 engaging in diametrically opposite slots N.

FIG. 9 shows delivery station 7, again in a view from above. It can be seen, from this illustration, that roller track 72, over the lifting cylinder 73, is divided by an intervening space 722 into two rows 721 of short rollers so that piston rod 74 with centering disc 75 provided thereon can travel through roller track 72 to unloading bell 42.

A complete working cycle for automated manufacture by the production unit described above proceeds as follows.

By timed rotation of floor 52 of pack forming station 5, a storage place 54 of that station arrives each time, with a pack of stator laminations *b* stacked in register with one another, at the loading position, in which floor aperture 55 and the bore through laminations *b* are situated coaxially relatively to piston rod 57 of lifting cylinder 56, preheating station 6 and loading bell 41.

In the upward travel of piston rod 57, the laminations pack is first of all pushed into the bore in the high frequency coil in preheating station 6.

After an intermediate halt required for preheating the pack of laminations, it is lifted further by piston rod 57 into loading bell 41.

The laminations *b* remain in their original alignment with the help of cross-shaped piston rod portion 58 during the entire lifting movement and in loading bell 41 also.

The laminations *b* which are not required for the stator laminations body B, about which casting is to be carried out, are separated, in loading bell 41, by advance of trimming wedges 411 by means of drives 412, and deposited again on storage place 54 when piston rod 57 moves downwards.

Loading bell 41 is then swung into the horizontal position with the stator laminations body B of requisite length held fast therein by trimming wedges 411, and unloading bell 42 also accompanies this movement.

Loading system 3, which, with loading tongs 37 and a clamping mandrel 8 gripped by the tongs, was in a position of readiness coaxial with pivoted loading bell 41 according to FIG. 2, now travels towards loading bell 41 and pushes clamping mandrel 8 into this bell until abutment is reached, end teeth 871 of the coupling disc 87 of clamping mandrel 8 coming into engagement with those of toothed wheel 44 of drive 43 in the head of loading bell 41.

After the clamping of the clamping mandrel 8 against the bore of the stator laminations body B by drive 43, the loading system is first of all moved rearwards towards the position of readiness from in front, and thus the stator laminations body B, clamped fast on clamping mandrel 8, is drawn out of loading bell 41.

Then loading system 3 with the loading tongs 37, which accompanies the stator laminations body B about which casting is to be carried out, and with empty unloading tongs 38, travels on gantry 2 into a waiting position, in the region of a loading/unloading position ("the load position") for die casting machine 1, unloading tongs 38 being situated above the mold of the machine.

This waiting position above die casting machine 1, in contrast to the position of readiness relatively to pivoting manipulator 4 according to FIG. 2 is situated nearer the side of gantry 2 on which pivoting manipulator 4 is arranged (left in FIG. 2).

During these steps, die casting machine 1 carried out a casting operation, casting about a stator laminations body B inserted in the previous working cycle in the mold together with the other clamping mandrel 8.

After the cooling time for the newly cast stator housing G has been completed, the mold is opened, its movable mold half $F_b$ together with the stator housing G, clamping mandrel 8 clamped therein, and core members K still closed (see FIG. 3) being withdrawn from the stationary mold half (not shown in FIG. 3).

During the return travel, central ejector A, by means of supporting pin 891, pushes head part 89 of clamping mandrel 8 in the direction away from movable mold half $F_b$ until collar 893 of supporting pin 891 abuts against shoulder surface 821 in axial bore 82 of clamping mandrel 8.

In this displacement of head part 89, the gates *a* are torn away from the newly cast stator housing G at the periphery of head part 89 (see FIG. 5). At the same time, the conical periphery of head part 89 pushed out of the stator housing in this way becomes free so that it can be gripped by unloading tongs 38 which remained in the waiting position above the mold.

After head part 89 is gripped by the lowered unloading tongs 38, core members K, which hold the stator housing G securely up to that time, are moved away from one another and, by rearward movement of loading system 3 towards the side of gantry 2 away from pivoting manipulator 4 in FIG. 2, the finish cast stator housing G, together with clamping mandrel 8, are removed from movable mold half $F_b$.

Subsequently, unloading tongs 38, with the stator housing G removed from the mold, are lifted and loading system 3 displaced on the gantry 2 in the longitudinal direction thereof so that loading tongs 37, together with clamping mandrel 8 and the body B, which is clamped thereon and about which casting is to be carried out, are in alignment with movable mold half $F_b$ (which is in the position shown in FIG. 2).

After loading tongs 37 moves downwards, the stator laminations body B, about which casting is again to be carried out, is inserted, together with clamping mandrel 8 securely clamped therein, into movable mold half $F_b$ by simultaneous advance of the loading system 3, until the body B comes to abut on the mobile mold half $F_b$.

Then core members K enter and, after the release and lifting of the loading tongs 37, the mold is closed, the hitherto withdrawn head part 89 of clamping mandrel 8 being also pushed back.

External ring 895 accompanies the displacement of head part 89 in each case.

Die casting macuine 1 can begin with the new injection operation.

After the unloading and loading operations, loading system 3, with the unloading tongs 38, which in fact accompanies the stator housing G removed from the mold, and with empty loading tongs 37, travels back along the gantry 2 into the position of readiness opposite pivoting manipulator 4 shown in FIG. 2.

The latter, at this instant, is in a horizontal position and loading bell 41 in the meantime has been loaded from the next storage place 54 advanced ibto the loading position with a new pack of stator laminations B.

First, loading system 3 comes to a standstill such that loading tongs 37 is in alignment with loading bell 41 and unloading tongs 38 with unloading bell 42.

Loading system 3 then travels toward pivoting manipulator 4, unloading tongs 38 pushing the stator housing G removed from the mold into unloading bell 42. When abutment has been reached, and the coupling of drive 43, 44 with coupling disc 87 of clamping mandrel 8 and the introduction of latches 421 have been carried out, umloading tongs 38 is released, and loading system 3 moves next in the direction of the position of readiness and then towards die casting machine 1 to such an extent that loading tongs 37 is now adjusted coaxially relatively to unloading bell 42.

After loading system 3 again advances towards pivoting manipulator 4, loading tongs 37 engages head part 89 which projects from clamping mandrel 8 situtated in unloading bell 42 and clamped in the stator housing G removed from the mold. The coating residue R is then detached from head part 89 as was explained in the description regarding FIG. 5.

At the subsequent opening of loading tongs 37, the casting residue R falls on to a discharge apparatus (not shown) after which loading system 3 can again advance, and loading tongs 37 can completely surround head part 89 and so can withdraw clamping mandrel 8 from stator housing G.

With clamping mandrel 8 in loading tongs 37, loading system 3 is next moved back towards the position of readiness and then displaced in the longitudinal direction such that loading tongs 37 can push clamping mandrel 8 into the new stator laminations body B standing ready in loading bell 41, and thus begin a new working cycle.

While the new working cycle starts, pivoting manipulator 4 is pivoted into the vertical position and the loading of loading bell 41 takes place with a new stator laminations body B, in the manner described, from pack forming station 5, and also the removal from unloading bell 42 of the stator housing G removed from the mold.

Latches 421 of unloading bell 42 retain the stator housing G therein until it is taken by the centering disc 73 carried by uowardly travelling piston rod 74 and then lowered on to roller track 72, piston rod 74 being mounted in lifting cylinder 73 disposed below delivery station 7.

The finished stator housing G then travels from roller track 72 by way of a conveyor belt to an intermediate store.

It can be seen from the embodiment described above that the present invention makes possible constructions which allow a considerable simplification and therefore acceleration of the handling of hollow insert parts and finish cast work pieces in automated manufacture in repetitive cycles. The relatively short cycle time of the embodiment described remains shorter than the casting cycle of the casting machine even in the case where small parts have to be cast, so that the leading role of the machine in the production unit can be insured as an important prerequisite for economical manufacture.

While a specific embodiment of the invention has been shown and described in detail to illustrate the application of the principles of the invention, it will be understood that the invention may be embodied otherwise without departing from such principles.

We claim:

1. Apparatus for the automated manufacture, in repetitive cycles, of composites constituted by apertured composite articles having the aperture in a prefabricated insert thereof, said apparatus comprising, in combination, a mold-forming machine operable to apply molten material about said insert, by a molding operation, to form said composite; plural clamping mandrels operable to be clamped in said apertures to constitute, temporarily, "mandrel-with-insert" and "mandrel-with-composite" combinations; a discharge station for discharging composites from said mandrels; a charging station for charging said mandrels with said inserts; and a loading system with holding means, including holders for holding said mandrels, and with conveying means; said loading system repetitively carrying out, in timed sequence, the following operations: (1) at a loading/unloading position for said machine, taking hold, using a holder, of a "mandrel-with-composite" from said machine; (2) at said loading/unloading position, loading in "mandrel-with-insert" from a holder into said machine; (3) at a set-off position at said discharge station, setting-off at least one composite from a respective holder; and (4) at a take-up position at said charging station, taking-up at least one insert with a respective holder.

2. Apparatus as claimed in claim 1, including means at said discharge station operable to set-off a composite at said set-off position while leaving the respective mandrel held in said holding means.

3. Apparatus as claimed in claim 1, including means at said charging station operable to charge an insert on a mandrel at said take-up position while the mandrel is held in said holding means.

4. Apparatus as claimed in claim 1, including two said clamping mandrels; said loading system, in each cycle, leaving one "mandrel-with-insert" in said machine while conveying the other "mandrel-with-composite" to said set-off position to set-off a composite, then conveying the mandrel to said take-up position for charging with an insert, and then conveying the "mandrel-with-insert" back into the region of said loading/unloading position in readiness for the succeeding cycle.

5. Apparatus as claimed in claim 1, including a pivoting manipulator operable to transfer at least composites from said set-off position to said discharge station and to transfer at least inserts from said charging station to said take-up position.

6. Apparatus as claimed in claim 1, in which each clamping mandrel comprises a cylindrical main body having a plurality of longitudinal grooves disposed symmetrically about its periphery; respective stepped wedges axially displaceable in said grooves; respective associated wedges extending into said grooves and co-operating with said stepped wedges so as to be displaceable radially of said cylindrical main body; coupling means at an end of said main body mounted for rotation relative to said main body; and means interconnecting said coupling means to all of said stepped wedges and operable, upon rotation of said coupling means, to displace said stepped wedges longitudinally in the respective grooves to displace said associated wedges radially outwardly of said main body to expand said mandrel to clamp said mandrel in the aperture of the pre-fabricated insert.

7. Apparatus as claimed in claim 6, in which said associated wedges carry respective outwardly directed clamping jaws; said coupling means being constituted by a coupling disc having teeth on its outer surface engageable by a driving means to drive said coupling disc; said means connecting said coupling disc to said stepped wedges comprising a threaded extension on said coupling disc threadedly engaged with a threaded sleeve engaged with said stepped wedges; said sleeve being mounted on said main body for axial displacement therealong while being restrained against rotation relative to said main body.

8. Apparatus as claimed in claim 7, in which said clamping jaws abut each other through the medium of sealing sliding surfaces.

9. Apparatus as claimed in claim 7, in which at least one said clamping jaw has a cross-section operable to prevent relative rotation of an apertured insert having an appropriately shaped aperture.

10. Apparatus as claimed in claim 9, in which said cross-section includes a centering rib on the outer surface of said at least one clamping jaw, extending parallel to an axial bore in said main body.

11. Apparatus as claimed in claim 6, including a plurality of sets of said wedges interchangeably engaging in said mandrel grooves; respective sets having respectively different characteristics as to shape and size, whereby said mandrels can be adapted for clamping in apertures having characteristics corresponding thereto.

12. Apparatus as claimed in claim 6, in which said main body has an axial bore therethrough formed, in a central region thereof, with an annular shoulder, said bore including a portion of smaller diameter spaced from said coupling means; a conical head part at the end of said main body remote from said coupling means; a central supporting pin on said conical head part guided in said smaller diameter bore portion for axial nonrotatable displacement relative to said main body; and a collar on the free end of said supporting pin operable to limit axial displacement of said central supporting pin, in a direction away from said coupling means, by abutting said annular shoulder surface.

13. Apparatus according to claim 12, in which each mandrel includes an annular internal compensating element releasably mounted on said main body, as an intermediate member, in the axial direction, between an abutment surface of said conical head part proximate an insert, on the one hand, and the insert when on said mandrel, on the other hand, and, in the radial direction, between the outer surface of said mandrel and an annular outer supporting element releasably secured at said abutment surface of said conical head part adjacent its periphery.

14. Apparatus as claimed in claim 13, wherein said internal compensating elements and said outer supporting elements have an axial length selected in accordance with that of an insert to be charged on said mandrel; said compensating element and said supporting element having internal dimensions corresponding to the dimensions of an insert to be charge on the mandrel.

15. A-paratus as claimed in claim 1, including a pivoting manipulator operable to transfer at least composites from said set-off position to said discharge position, and to transfer at least inserts from said charging station to said takeup position; said pivoting manipulator including a charging bell and a discharge bell; means mounting both said bells for conjoint pivotal movement between vertical and horizontal positions; said charging bell having an internal configuration adapted to the external configuration of said inserts; said discharge bell having an internal confuguration adapted to the external configuration of said composites.

16. Apparatus as claimed in claim 15, including trimming means on said charging bell in the region of the periphery of its mouth; and drive means operable to drive said trimming means toward and away from the axis of said charging bell.

17. Apparatus as claimed in claim 16, in which said trimming means includes at least one trimming wedge; said drive means being operable to drive said trimming wedge in a direction substantially perpendicular to the axis of said charging bell.

18. Apparatus as claimed in claim 15, including latching means on said discharge bell in the region of the periphery of its mouth; and drive means operable to drive said latching means toward and away from the axis of said discharge bell.

19. Apparatus as claimed in claim 15, in which each mandrel comprises a cylindrical main body having a plurality of grooves disposed symmetrically about its periphery, stepped wedges axially displaceable in each said groove, similar associated wedges extending into said grooves cooperating with said stepped wedges so as to be radially displaceable, and coupling means disposed at an end and rotatable relatively to said main body, said coupling means being connected to said stepped wedges such that upon rotation of said coupling means said stepped wedges are displaced axially in said grooves and said auxiliary wedges are displaced radially thereby to expand said mandrel for clamping it in said aperture; each of said bells having drive means remote from its mouth operable to engage said coupling means of a mandrel to clamp and unclamp the mandrel.

20. Apparatus as claimed in claim 15, in which said charging station includes a floor movable in the horizontal plane and having a plurality of storage places spaced at regular intervals thereon, for storage of at least components for inserts arranged therein in predetermined fashion; lifting means disposed beneath said floor coaxial with said charging bell, when said charging bell is in the vertical position; said floor being movable to bring said storage places between and into axial alignment with said charging bell and said lifting means, in timed sequence; each said storage place having a floor aperture for the passage of said lifting means through said floor, whereby said lifting means can lift at least a set of components, forming an insert, out of each storage space and into the charging bell.

21. Apparatus as claimed in claim 20, including a preheating station, having a through-bore for the inserts, disposed between said floor and said charging bell so as to be closely below the mouth of said charging bell and coaxial with said bell when said charging bell is in its vertical position.

22. Apparatus as claimed in claim 1, in which said delivery station includes a roller track, lowering means disposed below said roller track, said roller track, in the region of said lowering means, being divided into two roller rows separated by an intervening space; intervening space providing for passage of said lowering means when lowering a composite for discharge at said discharge station.

23. Apparatus as claimed in claim 22, wherein each of said lifting means and said lowering means comprises a piston and cylinder unit; said lifting means including a piston road with an end portion of a shape sppropriate to that of the aperture of the inserts; said lowering means having a piston rod with a centering disc at its free end.

24. Apparatus as claimed in claim 1, in which said loading means includes a track rail gantry providing for movement of said conveying means longitudinally of said track rail gantry; said conveying means including a trolley mounted for movement on said track rail gantry transversely of the longitudinal direction of said gantry; said holding means comprising gripping tongs mounted on said trolley with their axes parallel to each other, for vertical lifting and lowering movements; pressure cylinder asssemblies operable to move said trolley transversely of the longitudinal direction of said gantry and said gripping tongs vertically relative to said trolley; and tong jaws interchangeably mounted on said gripping tongs for gripping mandrels of different dimensional characteristics.

25. Apparatus as claimed in claim 24, including straps releasably secured to those end faces of said gripping tongs directed toward the inserts to be handled and acting as an abutment for a head part of said mandrels.

26. Apparatus as claimed in claim 25, in which the gripping tongs intended for loading a "mandrel-with-insert" into said forming machine have straps which are wedge shaped to perform a wedging action on a composite prior to discharge of the composite.

* * * * *